US005492318A

United States Patent [19]

Wright

[11] Patent Number: 5,492,318

[45] Date of Patent: Feb. 20, 1996

[54] SHEET ACCUMULATOR

[75] Inventor: William J. Wright, Killingworth, Conn.

[73] Assignee: Pitney Bowes Inc., Stamford, Conn.

[21] Appl. No.: 295,575

[22] Filed: Aug. 25, 1994

[51] Int. Cl.[6] ..... B65H 31/00

[52] U.S. Cl. ..... 271/211; 271/207

[58] Field of Search ..... 271/207, 211, 271/183, 177, 310

[56] References Cited

U.S. PATENT DOCUMENTS

| | | | |
|---|---|---|---|
| 3,537,704 | 11/1970 | Bond | 271/64 |
| 4,162,067 | 7/1979 | Horak et al. | 271/177 |
| 4,405,125 | 9/1983 | Kulpa et al. | 271/195 |
| 4,593,897 | 6/1986 | Silverberg | 271/212 |
| 5,133,542 | 7/1992 | von Kwiatkowski et al. | 271/211 X |
| 5,259,608 | 11/1993 | Pollich | 271/207 X |

FOREIGN PATENT DOCUMENTS

| | | | |
|---|---|---|---|
| 2532880 | 1/1977 | Germany | 271/183 |
| 0089763 | 3/1992 | Japan | 271/207 |
| 0209158 | 7/1992 | Japan | 271/211 |

*Primary Examiner*—William E. Terrell
*Assistant Examiner*—Carol L. Druzbick
*Attorney, Agent, or Firm*—Lawrence E. Sklar; Melvin J. Scolnick

[57] ABSTRACT

A paper sheet accumulator for receiving sheets of paper from an upstream, horizontal conveyor. The accumulator includes: a housing; an accumulation deck secured to the housing: an upper, accumulation roller operatively connected to the housing, the roller being located at the upstream end of the deck; a lower, accumulation roller below and contiguous with the upper, accumulation roller, the lower roller being operatively connected to the housing; and a device to provide a vacuum adjacent the lower, accumulation roller and the upstream end of the accumulation deck.

8 Claims, 3 Drawing Sheets

SHEET ACCUMULATOR

BACKGROUND OF THE INVENTION

The instant invention relates to apparatus for accumulating sheets of paper being fed in a horizontal plane seriatim into a stack and more particularly to such apparatus wherein almost no gap is required between the sheets as they are being fed seriatim.

In the process of inserting sheets of paper into envelopes, typically the sheets of paper are fed seriatim in a horizontal plane from upstream paper handling apparatus, such as document feeders or bursters, toward an accumulating device and then downstream to other paper handling apparatus, such as folders or inserters. The accumulator functions to collect a plurality of documents against a registration edge and form a registered collation which can be further processed.

A typical accumulator has a pair of feed rollers which receive sheets seriatim from an upstream, horizontal conveyor and feed the sheets onto an accumulating deck. The first sheet to be deposited on the accumulator deck becomes the bottom sheet, and each succeeding sheet deposited lies on top of the preceding sheet. It is obviously desirable to accumulate the sheets at the maximum possible speed consistent with the capability of the upstream and downstream apparatus. Conventional accumulators require that there be a significant gap, on the order of 2 to 6 inches, between the sheets on the conveyor prior to their being deposited on the accumulator deck to assure proper accumulating. The instant invention eliminates the need for a large gap between sheets on a horizontal conveyor and permits the conveyor upstream of the accumulator to feed sheets having gaps as small as ⅛ inch or less. Consequently, the throughput of the accumulator and all of the associated apparatus is increased without any increase in the speed of the conveyor or other apparatus associated with the accumulator.

SUMMARY OF THE INVENTION

Thus, the instant invention provides a paper sheet accumulator for receiving sheets of paper from an upstream, horizontal conveyor. The accumulator includes: a housing; an accumulation deck secured to the housing; an upper, accumulation roller operatively connected to the housing, said roller being located at the upstream end of the deck; a lower, accumulation roller below and contiguous with the upper, accumulation roller, the lower roller being operatively connected to the housing; and means to provide a vacuum adjacent the lower, accumulation roller and the upstream end of the accumulation deck.

Figure 1:
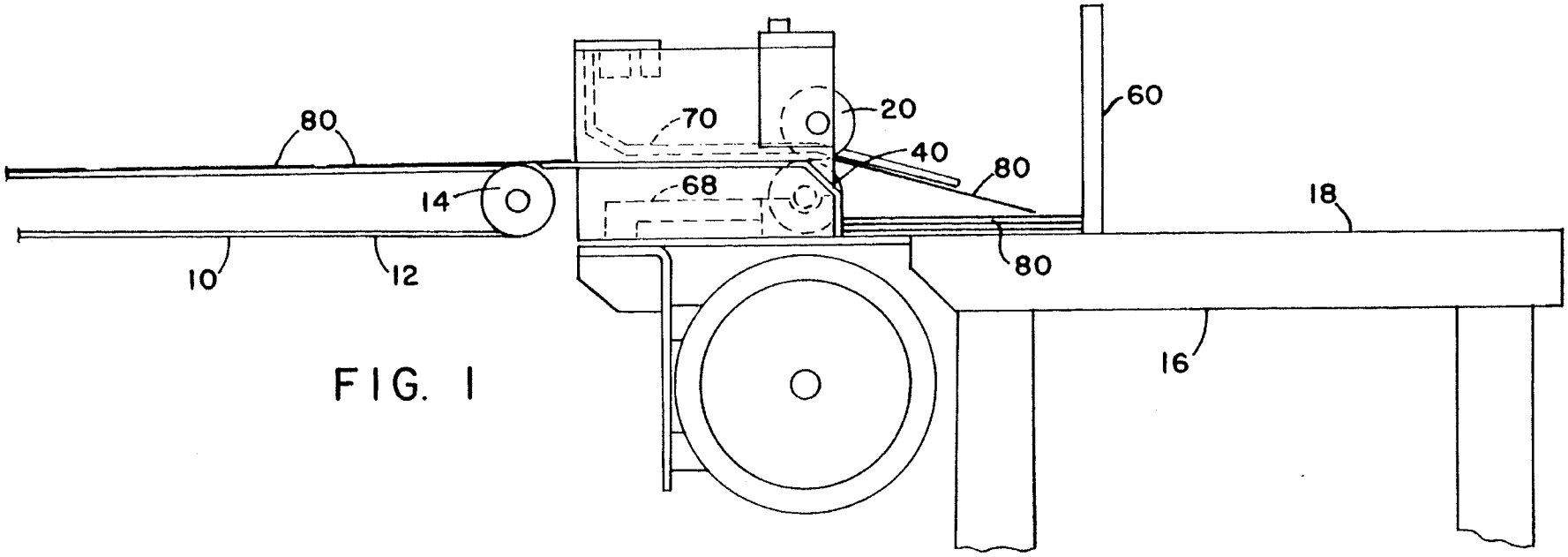
FIG. 1 is a side, elevational view of a conveyor and paper sheet accumulator in accordance with the instant invention.
Figure 2:
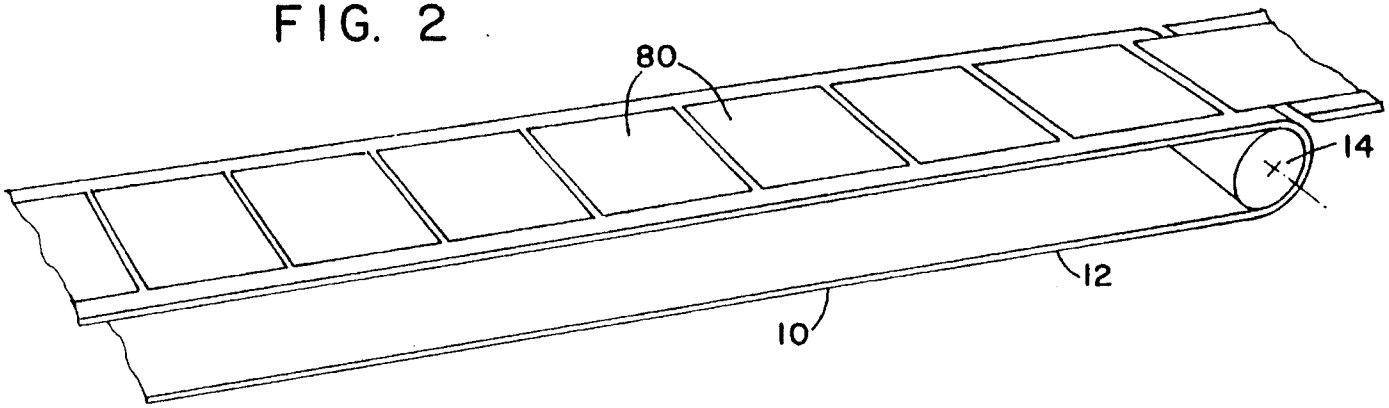
FIG. 2 is a perspective view of the conveyor seen in FIG. 1 with paper sheets on the conveyor belt.
Figure 3:
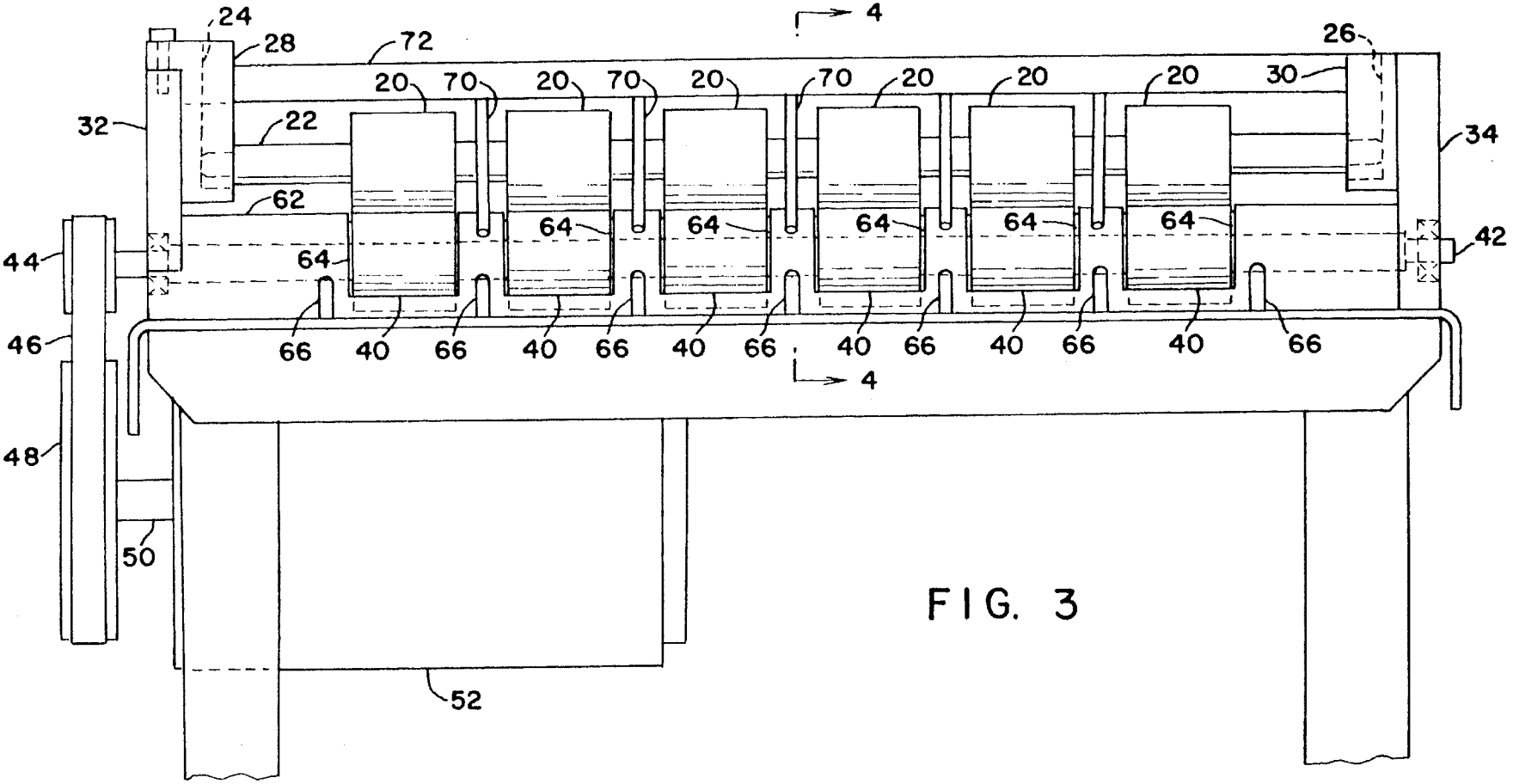
FIG. 3 is a front, elevational view of the accumulator seen in FIG. 1.

DETAILED DESCRIPTION OF THE PREFERRED EMBODIMENT in describing the preferred embodiment of the instant invention, reference is made to the drawings, wherein there is seen in FIG. 1 a horizontal conveyor 10 consisting of a flat belt 12 mounted on a pair of pulleys 14 (only one is shown). It should be noted that the belt 12 may consist of O-ring belts or multiple flat belts. Downstream of the conveyor 10 is a paper sheet accumulator generally designated 16 having an accumulation deck 18. On the input side of he accumulator 16 are a plurality of segmented, upper accumulation rollers 20 which are fixedly mounted on a shaft 22 rotatably seated at the bottom of a pair of slots 24 and 26 in a pair of brackets 28 and 30 respectively. The brackets 28 and 30 are secured to conveyor housing flanges 32 and 34 respectively which are secured in turn to the accumulation deck 18. The segmented, upper accumulation rollers 20 are spaced approximately 1" above the accumulation deck 18. Each of the upper, accumulation rollers 20 is contiguous with a segmented, lower accumulation roller 40. The lower accumulation rollers 40 are fixedly mounted on a shaft 42 which is rotatably seated in the conveyor housing flanges 32 and 34. One end of the shaft 42 is fixedly secured to a driven pulley 44. A timing belt 46 operatively connects the driven pulley 44 to a drive pulley 48 which is driven by a drive shaft 50 extending from a motor 52.

Figure 4:
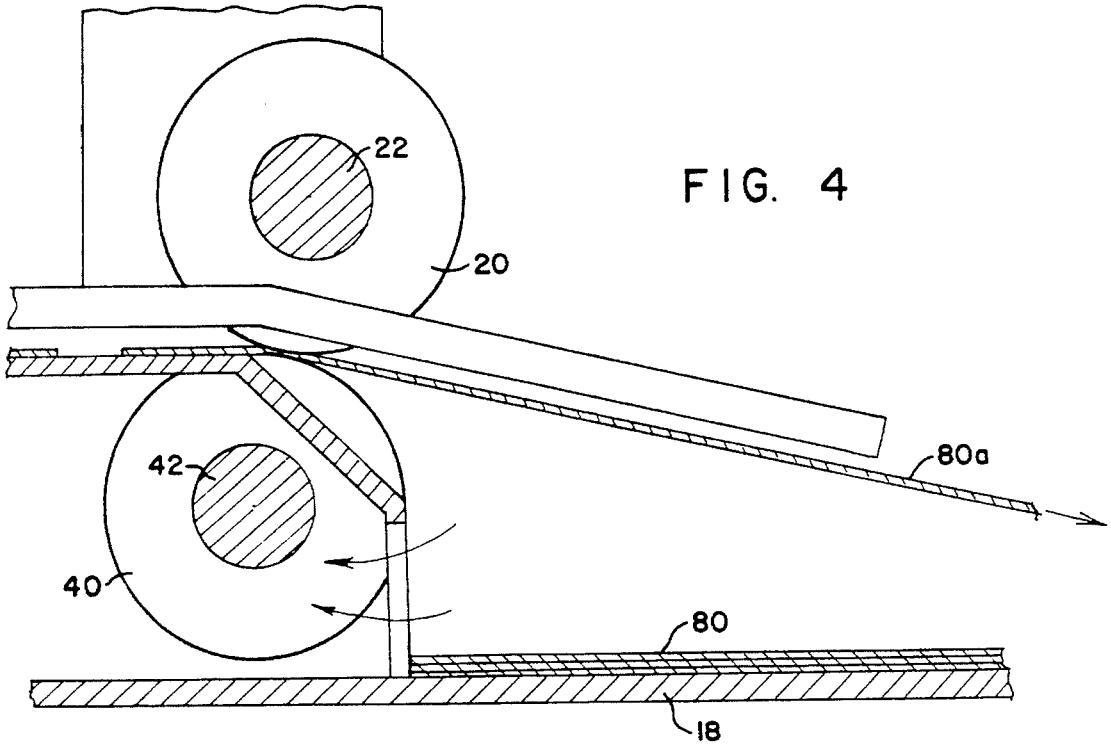
FIG. 4 is a sectional view taken on the plane indicated by the line 4—4 in FIG. 3 and shows a paper sheet being fed from the conveyor to a pile of sheets sitting in the accumulator.
Figure 5:
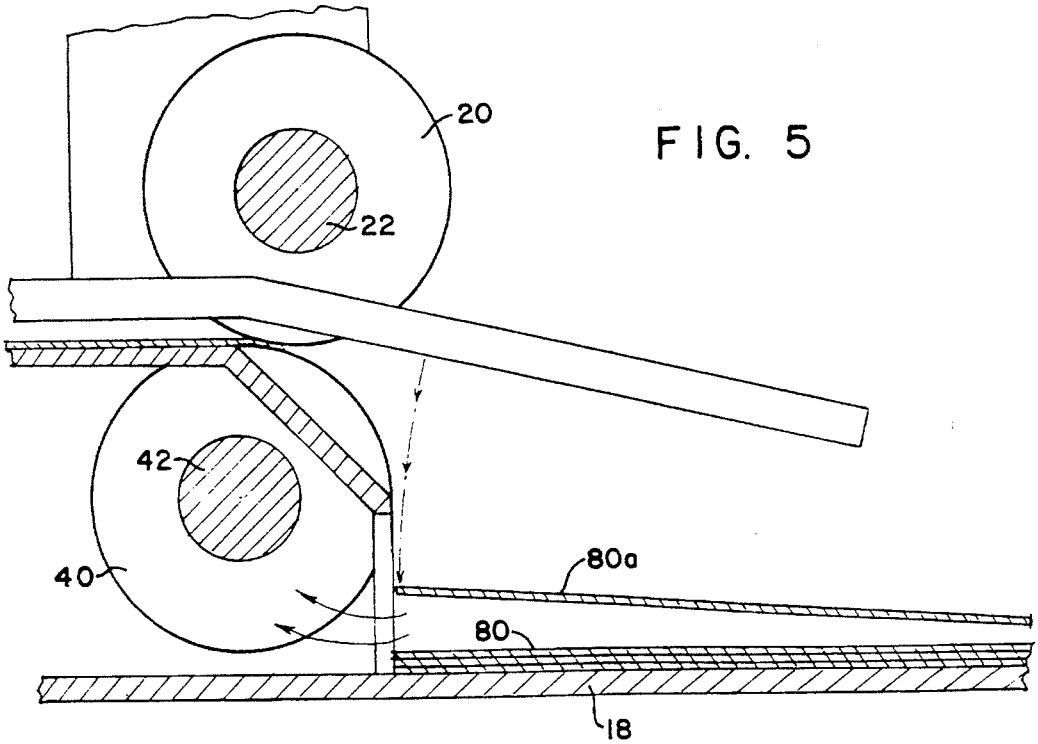
FIG. 5 is a similar to FIG. 4 but shows the paper sheet being urged down on top of the pile of sheets in the accumulator.

As best seen in FIGS. 4 and 5, the upper, accumulation rollers 20 are not directly over the lower, accumulation rollers 40, but rather their centers are situated about twelve degrees downstream of the centers of the lower rollers 40. At the downstream end of the accumulator 16 is a stop 60 (see FIG. 1) which is spaced from the accumulator rollers 20 and 40 one paper sheet width.

Situated between the housing flanges 32 and 34 is a plenum 62 which has a plurality of openings 64 therein to allow the upper rollers 20 to project beyond the plenum 62. Also located in the plenum 62 but below and adjacent the openings 64 are a plurality of vertical slots 66 which lead from the space above the accumulation deck 18 to a plurality of channels 68. A vacuum, or negative pressure, is pulled through the channels 68 by conventional means (not shown) to create negative pressure under the accumulation rollers 40. A plurality of paper guides 70 are adjustably secured to a square shaft 72 which is seated in the housing flanges 32 and 34.

The vertical slots 66 allow negative air pressure to be applied to all of the paper sheets 80 as the sheets 80 begin to accumulate in the accumulator 16. As the sheet 80*a* is fed through the accumulation rollers 20 and 40 and contacts the accumulation deck 18 or a preceding sheet 80, as seen in FIG. 4, the negative pressure begins to evacuate the air under the sheet 80*a*. As the sheet 80*a* exits the accumulation rollers 20 and 40, the trailing edge of the sheet 80*a* is immediately pulled down by the negative pressure, which allows the sheet immediately following the sheet 80*a* to follow immediately behind the first sheet 80*a* with virtually no gap therebetween.

After a set of sheets 80 is accumulated on the deck 18, a standard removal system is employed to push the accumulated sheets 80 from the accumulator 16 to allow the next accumulation to begin.

From the foregoing description, it can be seen that because of the negative pressure supplied by the vertical slots 66, sheets 80 can be fed from the conveyor flat belt 12 to the accumulation deck 18 with minimal or no gap between the sheets 80 as they are fed on the belt 12. A preferred gap between sheets 80 on the belt 12 is about 1/16", but gaps approaching 0 are possible. Of course, larger gaps may also be employed, recognizing that a two inch gap has been common in prior art machines.

It should be understood by those skilled in the art that various modifications may be made in the present invention without departing from the spirit and scope thereof, as described in the specification and defined in the appended claims.

What is claimed is:

1. Apparatus for conveying and accumulating a plurality of sheets of paper seriatim, comprising:

a horizontal conveyor for conveying sheets of paper with a spacing of about 1/8 inch seriatim from an upstream position to a downstream position;

an accumulator housing located downstream of said horizontal conveyor;

an accumulation deck secured to said housing and located in a plane below said horizontal conveyor, said deck having an upstream and a downstream end;

an upper, accumulation roller operatively connected to said housing, said roller located at the upstream end of said deck;

a lower, accumulation roller below and contiguous with said upper, accumulation roller, said lower roller operatively connected to said housing; and wherein said upper roller is downstream of said lower roller; and means to provide a vacuum adjacent said lower, accumulation roller and the upstream end of said accumulation deck, wherein said vacuum immediately pulls down the trailing edge of each sheet of paper as said sheet of paper drops down from said horizontal conveyor onto said accumulation deck.

2. The apparatus of claim 1, wherein said housing includes a pair of flanges located on either side of said accumulation deck at the upstream end of said accumulation deck.

3. The apparatus of claim 2, additionally comprising a first shaft rotatably mounted in said flanges for rotatably supporting said upper, accumulation roller, and a second shaft rotatably mounted in said flanges for rotatably supporting said lower, accumulation roller.

4. The apparatus of claim 3, additionally comprising a plurality of upper, accumulation rollers rotatably mounted on said first shaft, and an equal plurality of lower, accumulation rollers rotatably mounted on said second shaft, and wherein each of said upper rollers forms a pair of rollers with said lower rollers.

5. The apparatus of claim 4, additionally comprising means to drive said second shaft, and wherein said lower, accumulation rollers are fixedly secured to said second shaft.

6. The apparatus of claim 4, additionally comprising a plenum extending between said housing flanges, said plenum having openings therein for said lower, accumulation rollers.

7. The apparatus of claim 6, wherein said vacuum means includes a plurality of slots in said plenum between said openings for said lower rollers, whereby negative pressure is created above said accumulation deck.

8. The apparatus of claim 1, wherein the center of the upper roller is about twelve degrees downstream of the center of the lower roller.

* * * * *